US005645226A

United States Patent [19]

Bright

[11] Patent Number: 5,645,226

[45] Date of Patent: Jul. 8, 1997

[54] SOLENOID MOTION INITIATOR

[75] Inventor: John S. Bright, Newport News, Va.

[73] Assignee: Siemens Automotive Corporation, Auburn Hills, Mich.

[21] Appl. No.: 387,681

[22] Filed: Feb. 13, 1995

[51] Int. Cl.[6] ..... F02M 51/06

[52] U.S. Cl. ..... 239/585.1

[58] Field of Search ..... 251/129.06; 239/585.1–585.5

[56] References Cited

U.S. PATENT DOCUMENTS 4,669,660 6/1987 Weber ..... 251/129.06 X 4,678,000 7/1987 Kushida ..... 251/129.06 X 4,750,706 6/1988 Schlagmuller ..... 251/129

4,907,745 3/1990 Messingschlager ..... 239/585.5 X

FOREIGN PATENT DOCUMENTS 1290007 2/1987 U.S.S.R. ..... 239/585.4

*Primary Examiner*—Kevin Weldon

*Attorney, Agent, or Firm*—Russel C. Wells

[57] ABSTRACT

A typical solenoid-operated fuel injector solenoid motion initiator provided to initiate motion of the armature during de-energization of the solenoid. The solenoid motion initiator is a piezoelectric device mounted adjacent to or within the pole of the stator of the solenoid.

8 Claims, 3 Drawing Sheets

SOLENOID MOTION INITIATOR

FIELD OF THE INVENTION

This invention relates generally to electrically operated valves, such as fuel injectors for injecting liquid fuel into an internal combustion engine, and particularly to a solenoid motion initiator for initiating motion during energization and de-energization of such valves.

BACKGROUND OF THE INVENTION

Electrically operated valves, such as fuel injectors for injecting liquid fuel into an internal combustion engine, spray and atomize fuel. The fuel injector, then, is a solenoid through which fuel is metered. Typically, a solenoid valve comprises an armature movable between a first and second position. The extremes of these first and second positions are often defined by mechanical stops. Armatures can be moved in one direction by an electro-magnetic force generated by a coil of wire and moved in the opposite direction by a return spring. When the armature impacts a stop, it bounces. Each bounce of the armature, or valving element, meters a small uncontrolled amount of fuel into the engine, to the detriment of emissions.

Electromagnetic solenoids require certain times to initiate motion during energization and de-energization. When electric current is applied to the injector coil, a magnetic field is created. This causes the armature to move upward, allowing fuel, under pressure, to flow out of the injector nozzle. When the injector is de-energized, the flow of fuel is halted.

Piezoelectric actuators have been tried for fuel injectors in the past, but have proved impractical because displacement of the actuator is too small. Various mechanical motion amplifiers have proved impractical, also because displacement of the actuator is too small.

It is seen then that it would be desirable to have a solenoid motion initiator capable of providing the necessary displacement as well as the necessary speed for improved linear flow range.

SUMMARY OF THE INVENTION

This need is met by the solenoid motion initiator according to the present invention, wherein a piezoelectric valve is used as an initiator device. The piezoelectric valve initiator of the present invention may be incorporated in a typical high pressure direct injection fuel injector for gasoline engines. Fuel is delivered during four distinct phases of injector operation, including opening flight, open dwell, closing delay, and closing flight.

Briefly, the invention comprises the implementation of certain constructional features into the fuel injector. Principles of the invention are of course potentially applicable to forms of fuel injectors other than the one specifically herein illustrated and described.

In accordance with one embodiment of the present invention, a conventional fuel injector comprises solenoid motion initiator means to initiate motion during energization and de-energization. The solenoid provides force and displacement, and the solenoid motion initiator means comprises a piezoelectric device to provide speed for improved linear flow range. The location of the piezoelectric device can vary without compromising its function. For example, the piezoelectric device can be contained within an annular space inside the stator inner pole to push against the armature, or within an annular space outside the stator inner pole to push against the armature. The piezoelectric device may also be contained within a sector of the stator inner pole. Alternatively, the piezoelectric device may be situated to force the armature and stator apart by forcing fuel between the armature and stator, to open an air gap.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
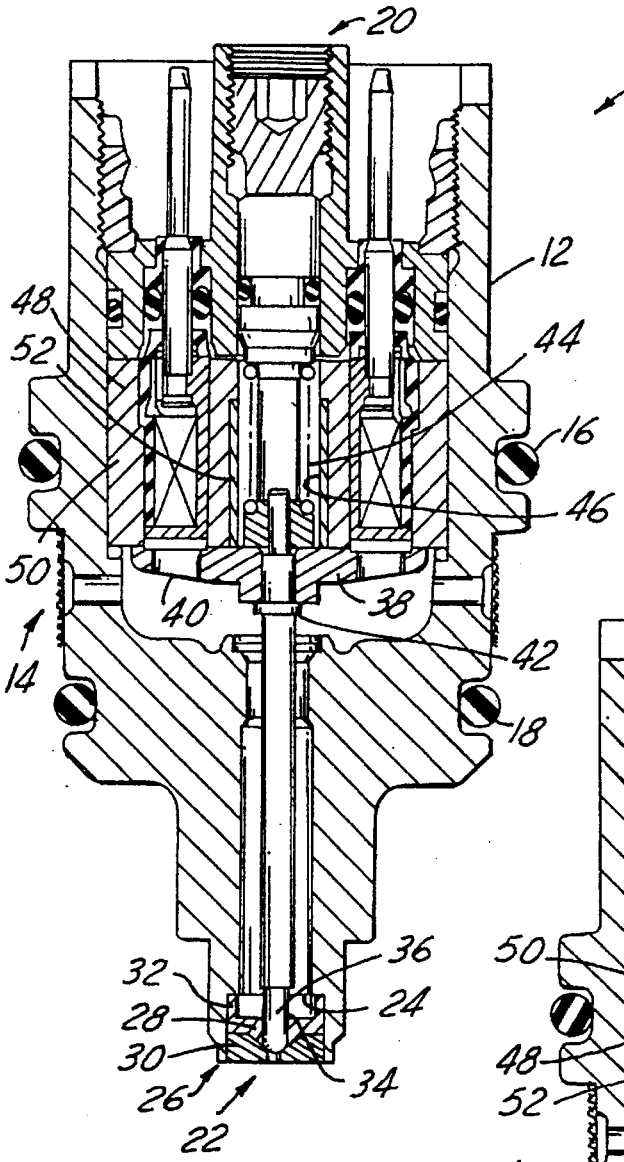
FIG. 1 is a cross section view through a fuel injector, embodying an inside annular form of the present invention.
Figure 2:
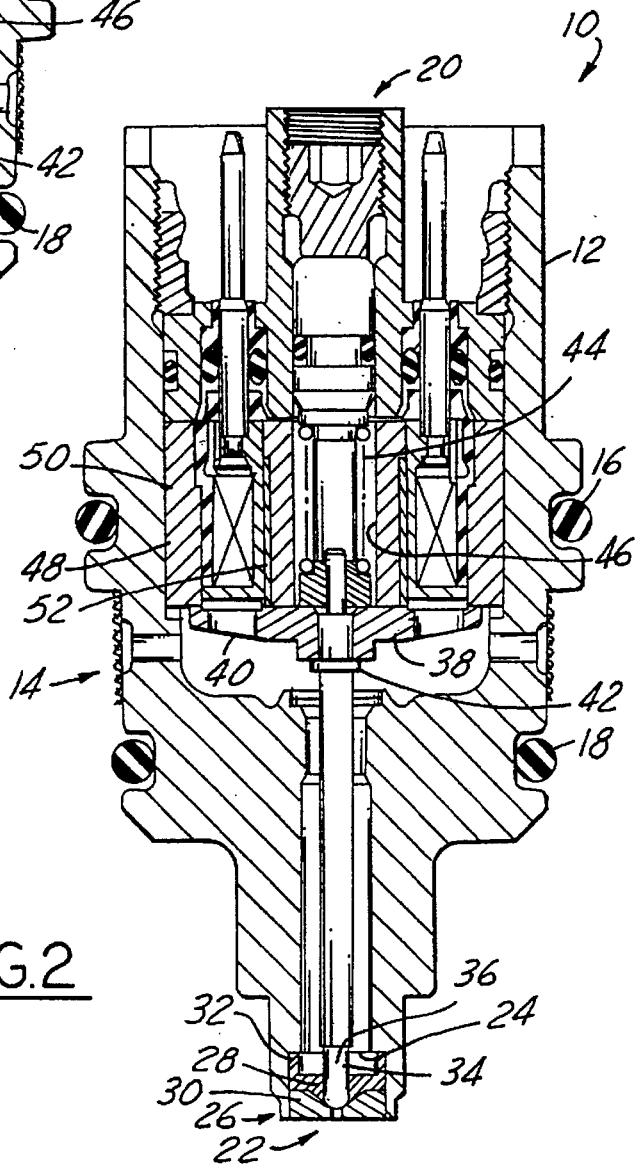
FIG. 2 is a cross section view through a fuel injector, embodying an outside annular form of the present invention.

Referring to the drawings, corresponding reference numerals refer to like parts throughout the drawings. In FIGS. 1–4 there is illustrated partly in cross section, a typical fuel injector 10 designed to inject fuel into an internal combustion engine. The typical spherical needle and cone fuel injector 10 is designed to operate at fuel pressures over 1000 psi. The injector 10 includes a tubular housing 12 made from nonmagnetic stainless steel. The inside of the tubular housing 12 contains a plurality of different diameters to form typical various shoulders for a variety of different functions. Positioned along the outside of the housing 12 and on either side of an inlet 14 are sealing means 16 and 18 to seal the injector 10 in a bore of an engine or manifold where it is located. The housing 12 has an open end 20, and an outlet end 22. The outlet end 22 is counterbored to form a shoulder 24 for locating a seat assembly 26 and a spray generator 28. The seat assembly 26 is comprised of a valve seat 30 and a swirl guide 32.

The valve seat 30 is swaged in the housing member 12 for locating the valve seat 30 and the spray generator 28 against the shoulder 24 at the end of the counterbore. The valve seat 30 may include a sealing means 32 such as a c-shaped metal seal to prevent leakage of fuel from around the valve seat 30. The sealing means should be a very high temperature seal which will not break down when subjected to the high temperatures at the outlet end 22 of the injector 10. Adjacent to the valve seat 30 is the spray generator 28 having an axially aligned bore 34 through which reciprocates a needle valve 36.

The needle valve 36 has a spherical radius for mating with the valve seat 30 to close the injector 10. At an end of the needle valve 36, opposite the spherical radius, there is a needle-armature means 38 comprising an armature member 40 and a damping member 42. The armature member 40 is located on the needle valve 36 abutting the damping member 42 and is free to move, very slightly, axially along the needle valve 36 against the damping member 42 which may be a belleville washer. The end of the needle valve 36 is received in a spring retainer 44 which is slidably received in a bore 46 in an inner pole 48 of a stator 50 of the solenoid core.

In accordance with the present invention, a solenoid motion initiator 52 comprises a piezoelectric device for use with a typical conventional electromagnetic solenoid. The conventional electromagnetic solenoid is used to provide the force and displacement necessary, while piezoelectric actuator 52 is used to provide the speed necessary for improved linear flow range.

Figure 3:
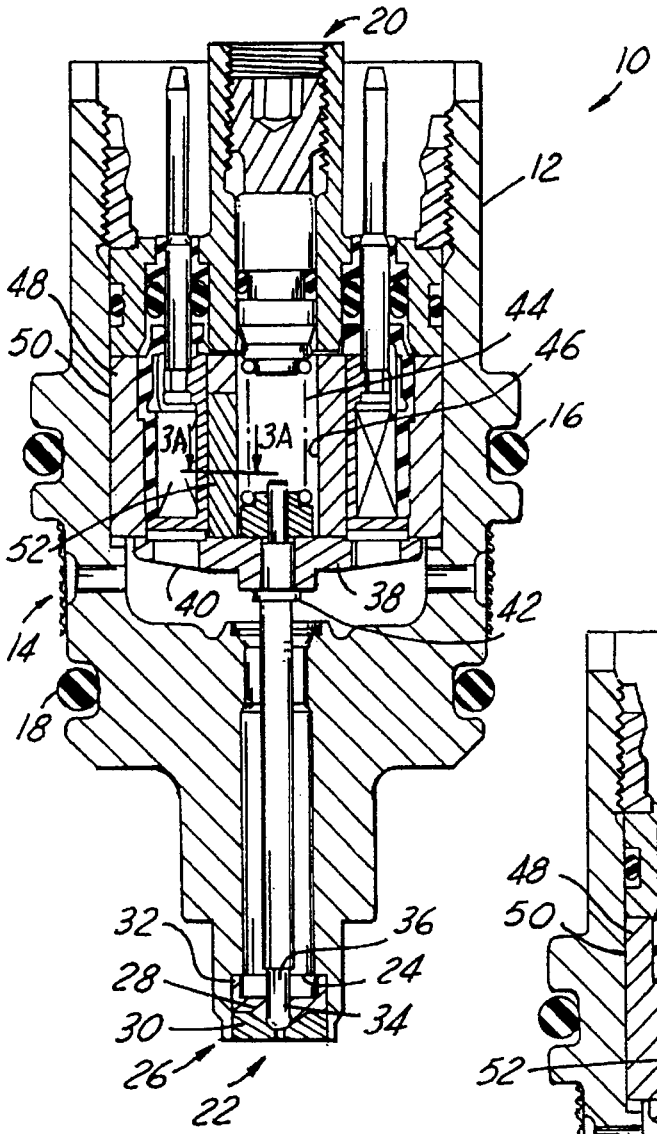
FIG. 3 is a cross section view through a fuel injector, embodying a plug version of the present invention.
Figure 4:
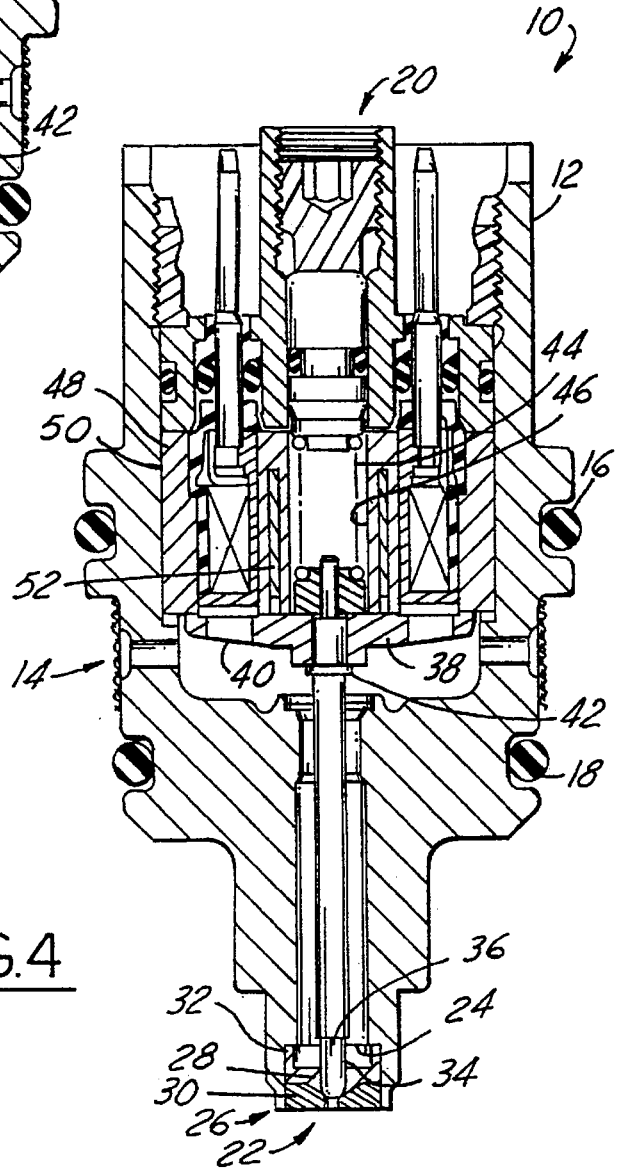
FIG. 4 is a cross section view through a fuel injector, embodying a hydraulic version of the present invention.

FIGS. 1 through 4 illustrate a typical high pressure direct injection fuel injector for gasoline engines, with the addition of the piezoelectric valve closing initiator device 52. The location of the piezoelectric actuator 52 can vary, as illustrated in the drawings. In FIG. 1, for example, the piezoelectric actuator 52 is contained within an annular space inside the stator inner pole. The piezoelectric actuator pushes against the armature. Alternatively, in FIG. 2, the piezoelectric actuator 52 is contained within an annular space outside the stator inner pole, and also pushes against the armature. In FIG. 3, the piezoelectric actuator 52 is contained within a sector of the armature inner pole, still situated to push against the stator. In FIG. 4, the piezoelectric actuator 52 forces the armature and stator apart by forcing fuel between them.

Figures 5A, 5B, 5C:
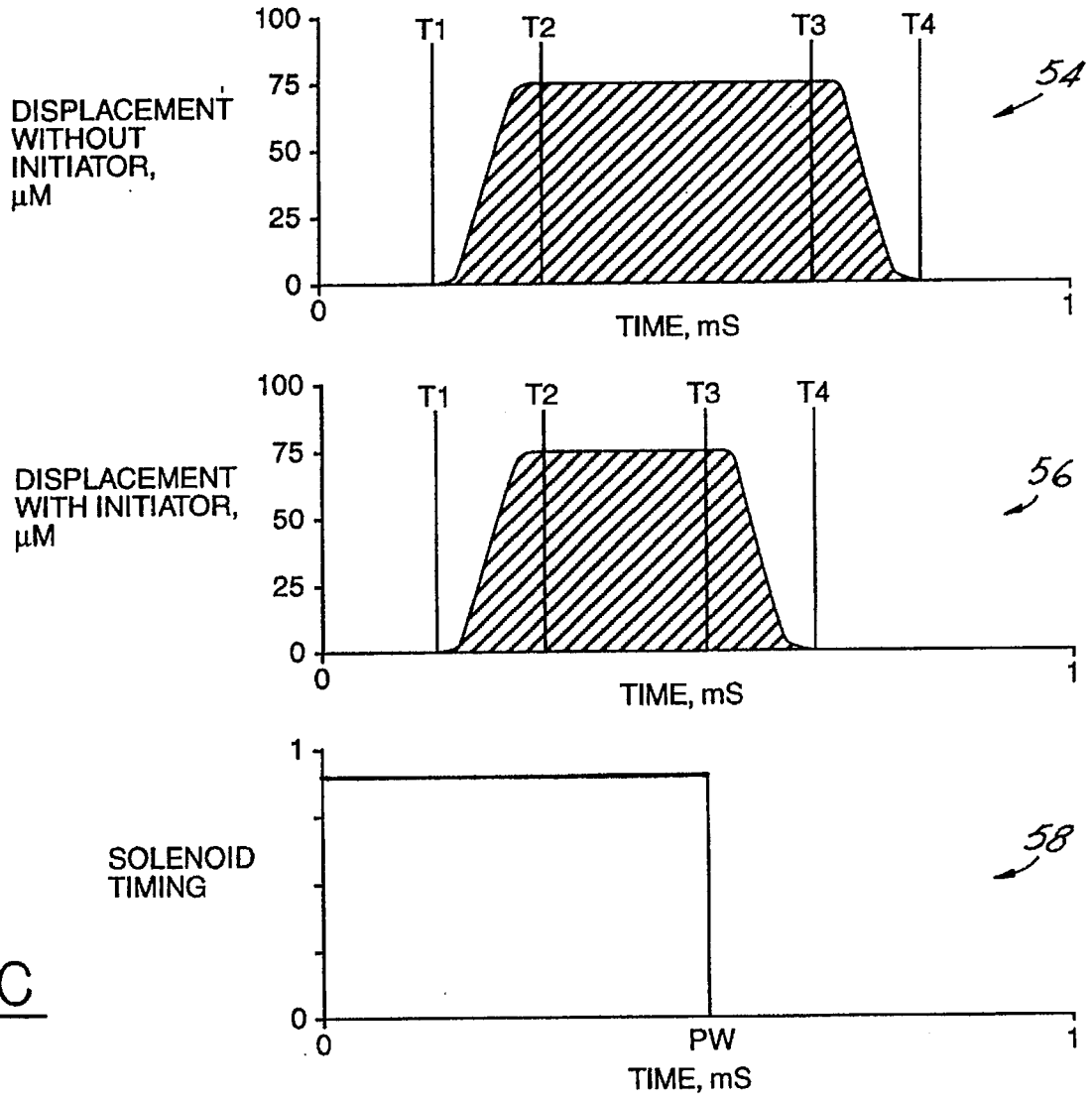
FIGS. 5A and 5B are graphical representations of displacement.
FIG. 5C is a solenoid timing graph.

Referring now to FIGS. 5A and 5B, graphic representations 54 and 56 of displacement without the initiator of the present invention and with the motion initiator of the present invention, respectively, are illustrated with respect to a solenoid timing graph 58 of FIG. 5C. In FIGS. 5A and 5B, fuel is delivered during four distinct phases of injector operation, including (1) opening flight, from T1 to T2; (2) open dwell, from T2 to PW; (3) closing delay, from PW to T3; and (4) closing flight, from T3 to T4.

In conventional electromagnetic solenoid valve fuel injectors, as illustrated in graph 54 of FIG. 5A, opening motion begins when the magnetic force between the armature and stator exceeds a value of return spring plus hydraulic forces, T1. Closing motion begins when the magnetic force decays to a value below the value of the return spring plus hydraulic forces, T3. Fuel is delivered between times T1 and T4.

In accordance with the present invention, as illustrated in graph 56 of FIG. 5B, opening motion begins when the magnetic force between the armature and stator exceeds a value of return spring plus hydraulic forces, T1. Closing motion begins when the piezoelectric actuator 52 forces open an energized air gap, resulting in a rapid reduction in magnetic force below the value of the return spring plus hydraulic forces, T3. In this situation, the value of T3 minus pulse width (PW) is reduced to virtually zero. Fuel is delivered between times T1 and T4. Minimum fuel delivery mass is reduced because fuel delivery between PW and T3 is virtually eliminated. Linear flow range of the injector is approximately doubled by this reduction in minimum fuel delivery capability.

Power for the piezoelectric actuator can be obtained from the natural flyback voltage of the solenoid upon de-energization, or from an external source. In the case of an external source, timing of this relative to PW can be optimized.

It will be understood that there are various alternative configurations which may be employed, in addition to the configurations illustrated and described herein, without departing from the scope and spirit of the invention. For example, a similar piezoelectric actuator could be applied between the injector housing and armature to initiate opening. Alternatively, a hydraulic motion initiator could incorporate the piezoelectric actuator between an adjusting screw and adjusting pin of the injector, to push the adjusting pin down and force fuel between the armature and stator to open an air gap. Those skilled in the art will realize other variations as well.

It should be noted that the configurations shown in FIGS. 1–4 depict typical envelops within which the piezoelectric actuator 52 may lie, but not necessarily the shape of the actuator itself. For example, piezoelectric stacks can be used to provide a fraction of armature displacement. Additionally, greater displacements can be achieved with bending type actuators.

Having described the invention in detail and by reference to the preferred embodiments thereof, it will be apparent that principles of the invention are susceptible to being implemented in other forms of solenoid-operated valves without departing from the scope of the invention defined in the appended claims.

What is claimed is:

1. In a solenoid-operated fuel injector having:

a housing forming an enclosure;

stator means with an inner and outer pole located in said enclosure;

a solenoid coil wound on said stator means, said solenoid being selectively energized by electric current to operate the fuel injector;

an inlet to convey liquid fuel into said enclosure;

an outlet via which fuel is ejected from said enclosure;

means within said enclosure providing a flow path from said inlet to said outlet;

an armature for opening and closing said flow path;

a valve mechanism disposed within said flow path and operated by said solenoid coil acting through said armature to open and close said flow path; wherein the improvement comprises:

solenoid motion initiator means, comprising a piezoelectric device, for initiating motion of said armature during de-energization of said solenoid, said motion initiator being initiated when said solenoid is de-energized to provide force to separate said armature from said stator means.

2. A fuel injector as set forth in claim 1 wherein said piezoelectric device is contained within an annular space inside said stator inner pole to push against said armature.

3. A fuel injector as set forth in claim 1 wherein said piezoelectric device is contained within an annular space outside said stator inner pole to push against said armature.

4. A fuel injector as set forth in claim 1 wherein said piezoelectric device is situated to force said armature and stator apart by forcing fuel between said armature and stator.

5. A method for attenuating noise in a solenoid-operated fuel injector, the injector comprising the steps of forming an enclosure containing a solenoid coil and an associated stator outer and inner pole;

selectively energizing said solenoid coil by an electric current for operating the fuel injector, connecting an inlet connector tube into said solenoid coil to convey liquid fuel into said enclosure, forming an outlet via which fuel is ejected from said enclosure, placing a valve mechanism within said enclosure between said inlet connector tube and said outlet;

operating said valve mechanism by said solenoid coil acting through a spring-biased armature to open and close a flow path through said enclosure between said inlet connector tube and said outlet, wherein said armature causes impact forces to be exerted axially on said inlet connector tube end during the opening and on said valve mechanism during the closing of said flow path, providing solenoid motion initiator means to initiate motion during de-energization, said solenoid providing force and displacement, said solenoid motion initiator means comprising a piezoelectric device and then placing said piezoelectric device in the inner pole of said stator to force the armature and stator apart by forcing fuel between the armature and stator.

6. A method for attenuating noise in a solenoid-operated fuel injector, the injector comprising a housing forming an enclosure which contains a solenoid coil that is selectively energized by electric current to operate the fuel injector, an inlet connector tube that extends into said solenoid coil to convey liquid fuel into said enclosure, an outlet via which fuel is injected from said enclosure, a valve mechanism that is disposed within said enclosure between said inlet connector tube and said outlet and that is operated by said solenoid coil acting through a spring-biased armature to open and close a flow path through said enclosure between said inlet connector tube and said outlet, wherein said end of said armature causes impact forces to be exerted axially on said inlet connector tube end during the opening and closing of said flow path, and an associated stator and stator inner pole, characterized by the step of: providing solenoid motion initiator means to initiate motion during energization and de-energization, said solenoid providing force and displacement, and said solenoid motion initiator means comprising a piezoelectric device to provide speed for improved linear flow range.

7. A method as set forth in claim 6 characterized further in that said piezoelectric device is contained within an annular space inside the stator inner pole to push against said armature.

8. A method as set forth in claim 6 characterized further in that said piezoelectric device is contained within an annular space outside the stator inner pole to push against said armature.

* * * * *